US006499496B1

(12) United States Patent
Young

(10) Patent No.: US 6,499,496 B1
(45) Date of Patent: Dec. 31, 2002

(54) PORTABLE RAIN SHELTER

(76) Inventor: Freddie W. Young, 10427 Shoe Creek, Baton Rouge, LA (US) 70818

( * ) Notice: Subject to any disclaimer, the term of this patent is extended or adjusted under 35 U.S.C. 154(b) by 0 days.

(21) Appl. No.: 09/615,637

(22) Filed: Jul. 13, 2000

(51) Int. Cl.[7] ..... E04H 15/04

(52) U.S. Cl. ..... 135/90; 135/16; 135/21; 135/95; 135/96; 135/98; 135/117; 135/901; 52/73

(58) Field of Search ..... 135/90, 95, 96, 135/98, 16, 117, 901, 902, 21; 182/135, 137, 188, 222, 48, 129, 20; 52/73, 74

(56) References Cited

U.S. PATENT DOCUMENTS

| | | | | | |
|---|---|---|---|---|---|
| 3,116,808 | A | * | 1/1964 | Riley | |
| 3,990,536 | A | | 11/1976 | Wilburn | |
| 4,056,902 | A | * | 11/1977 | Ziegler, Jr. | 52/73 |
| 4,134,474 | A | * | 1/1979 | Stavenau et al. | 182/187 |
| 4,246,981 | A | * | 1/1981 | Stavenau | 182/116 |
| 4,410,066 | A | | 10/1983 | Swett | |
| 4,458,707 | A | | 7/1984 | Lindaman | |
| 4,493,395 | A | * | 1/1985 | Rittenhouse | 182/187 |
| 4,505,286 | A | | 3/1985 | Madion | |
| 4,526,307 | A | * | 7/1985 | Parker | 224/154 |
| 4,739,785 | A | | 4/1988 | Poulson | |
| 4,805,655 | A | | 2/1989 | Justice | |
| 4,813,441 | A | * | 3/1989 | Kepley | 135/90 |
| 4,951,696 | A | * | 8/1990 | Jones, Sr. | 135/90 |
| 5,218,982 | A | * | 6/1993 | Kenji | 135/90 |
| 5,522,186 | A | * | 6/1996 | Jarman | 52/72 |
| 5,613,512 | A | * | 3/1997 | Bean | 135/90 |
| 5,669,403 | A | * | 9/1997 | Belcher et al. | 135/90 |
| 5,787,914 | A | | 8/1998 | Greywall | |
| 6,053,190 | A | * | 4/2000 | Brown, Jr. et al. | 135/90 |

* cited by examiner

*Primary Examiner*—Yvonne M. Horton
(74) *Attorney, Agent, or Firm*—Jones, Walker, Waechter, Poitevent, Carrere & Denegre, LLP

(57) ABSTRACT

A portable shelter for a tree blind including an upper tree gripping bracket and a tension member extending from the upper tree gripping bracket and operatively connecting to an overhead frame. A vertical spacing member maintains a vertical distance between the upper tree gripping bracket and a lower tree gripping bracket. A compressive member extends between the vertical spacing member and the overhead frame and the compressive member is adjustable relative to the vertical member. A rain fly covers the overhead frame.

12 Claims, 3 Drawing Sheets

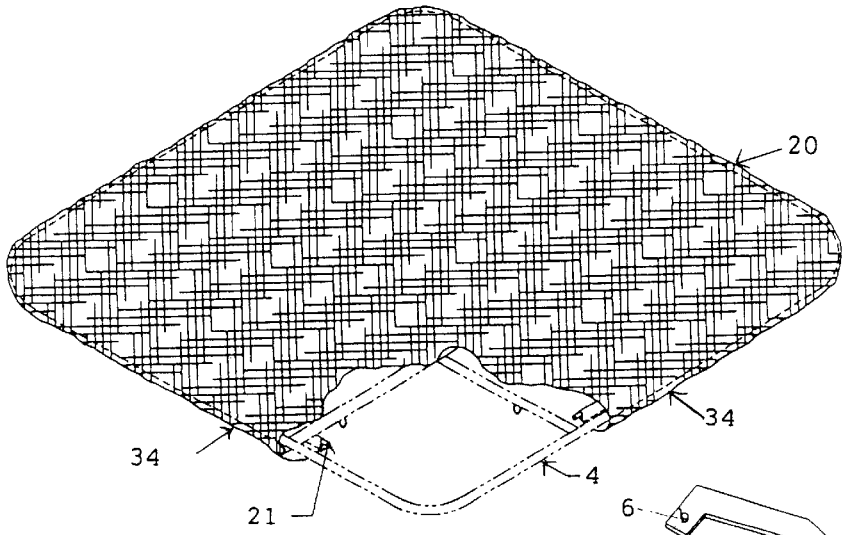
FIG 2
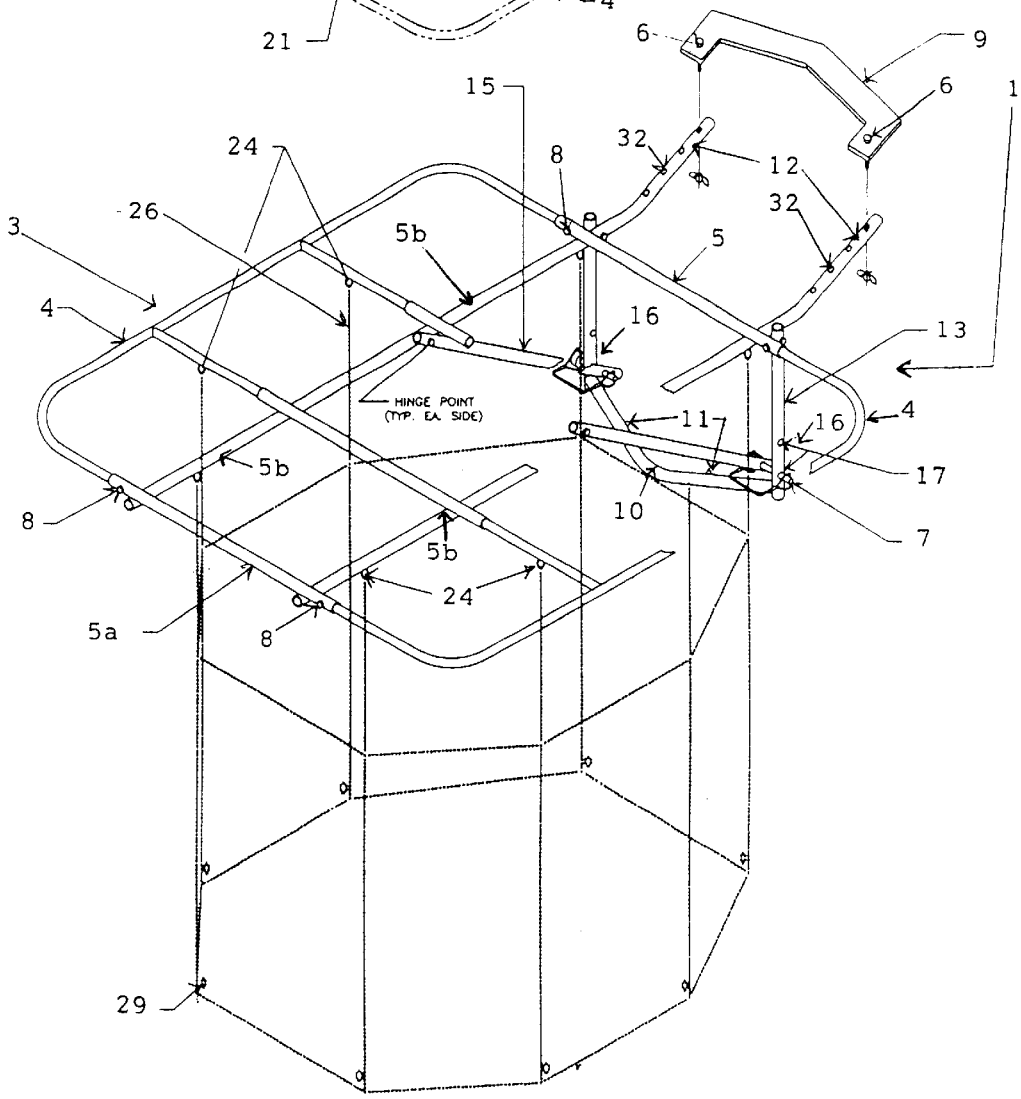

50
20
13
28
26
17
15
27
OPEN IN BACK AGAINST TREE
40

LADDER STAND CONFIGURATION 50
20
13
17
28
15
20
26
27
40
CLIMBING STAND CONFIGURATION
50
20
28
13
15
17
26
26
40

27
40
SMALL DIAMETER TREE CONFIGURATION

PORTABLE RAIN SHELTER

BACKGROUND OF THE INVENTION

1. Field of the Invention

The field of the present invention relates to portable shelters used by hunters and woodsmen. More particularly, the invention relates to portable overhead shelters which my be secured to a tree, typically in conjunction with a tree stand such as the portable type or lean-too type tree stand.

2. Prior Art

Tree stands for deer hunters and hunters of other game are well known in the art. There are also overhead shelters or covers which are intended to attach to the tree above the tree stand and help protect a hunter from rain and snow (or to provide shade on hot sunny days) while the hunter is stationed in tree stand. One type of overhead cover is seen in patents such as U.S. Pat. No. 4,505,286 to Madion and U.S. Pat. No. 4,458,707 to Lindaman. These overhead covers are basically umbrellas adapted to be attached to a tree. Because of these patent's minimal framing structure, they are relatively flimsy. Neither Madion nor Lindaman illustrate a structure that may extend very far from the tree trunk to which they are attached. This limits their ability to keep a hunter dry in a blowing rain. Moreover, their minimal framing structure renders them susceptible to damage from strong winds. Additionally, their cupped shape catches wind and makes it even more likely that strong winds will dislocate or damage these covers. Another type of overhead cover is disclosed in U.S. Pat. No. 4,805,655 to Justice. This cover is large triangular frame which extends outwardly from the tree with the apex of the triangle attaching to the tree. While this provides a relatively wide cover at the base of the triangle, it provides substantially less coverage as the sides of the triangle taper towards the tree. Thus the Justice cover provides very little protect from rain blowing from behind the hunter. Additionally, the Justice cover tends to have a large downward inclination as it extends away from the tree. This means the apex of the triangular cover must be position relative high up the tree in order to avoid the base of the triangle obstructing the hunter's view and ability to traverse his firearm. The inclined orientation of the Justice cover also makes it likely to catch the wind if the wind is blowing in a direction parallel to the inclination of the cover.

There are other types of tree stands which incorporate an overhead cover. One such tree stand is U.S. Pat. No. 4,410,066 to Swett. However, Swett discloses a heavily framed, enclosed tree stand having a roof. It will be apparent that devices such as Swett are too heavy to be easily carried up a tree. Because of the inherent dangers of falling while attempting to climb to a tree stand, it is highly desirable to have a overhead cover which is light enough not to impede the hunter as he or she climbs the tree.

OBJECTS AND SUMMARY OF THE INVENTION

It is object of this invention to provide a portable overhead shelter or cover for a tree stand which provides better protection from the elements than prior art devices.

It is another object of this invention to provide a portable overhead shelter which may be adjusted to maintain a level orientation when positioned on trees of different diameters.

It is still a further object to provide a portable overhead shelter which is light enough that, when assembled on the ground, may be easily carried by a person climbing a tree.

It is yet another object to provide a portable overhead shelter which is designed to be "climbed" up a tree in conjunction with a climbing tree stand.

Therefore, the present invention provides a portable shelter for a tree blind. The shelter includes an upper tree gripping bracket and a tension member extending from the upper tree gripping bracket and operatively connecting to an overhead frame. A vertical spacing member maintains a vertical distance between the upper tree gripping bracket and a lower tree gripping bracket. A compressive member extends between the vertical spacing member and the overhead frame and the compressive member is adjustable relative to the vertical member.

BRIEF DESCRIPTION OF THE DRAWINGS

FIG. 2 is similar to FIG. 1, but has several framing members cut away to better illustrate other supporting members of the present invention.

DETAILED DESCRIPTION OF PREFERRED EMBODIMENTS OF INVENTION

Figure 1:
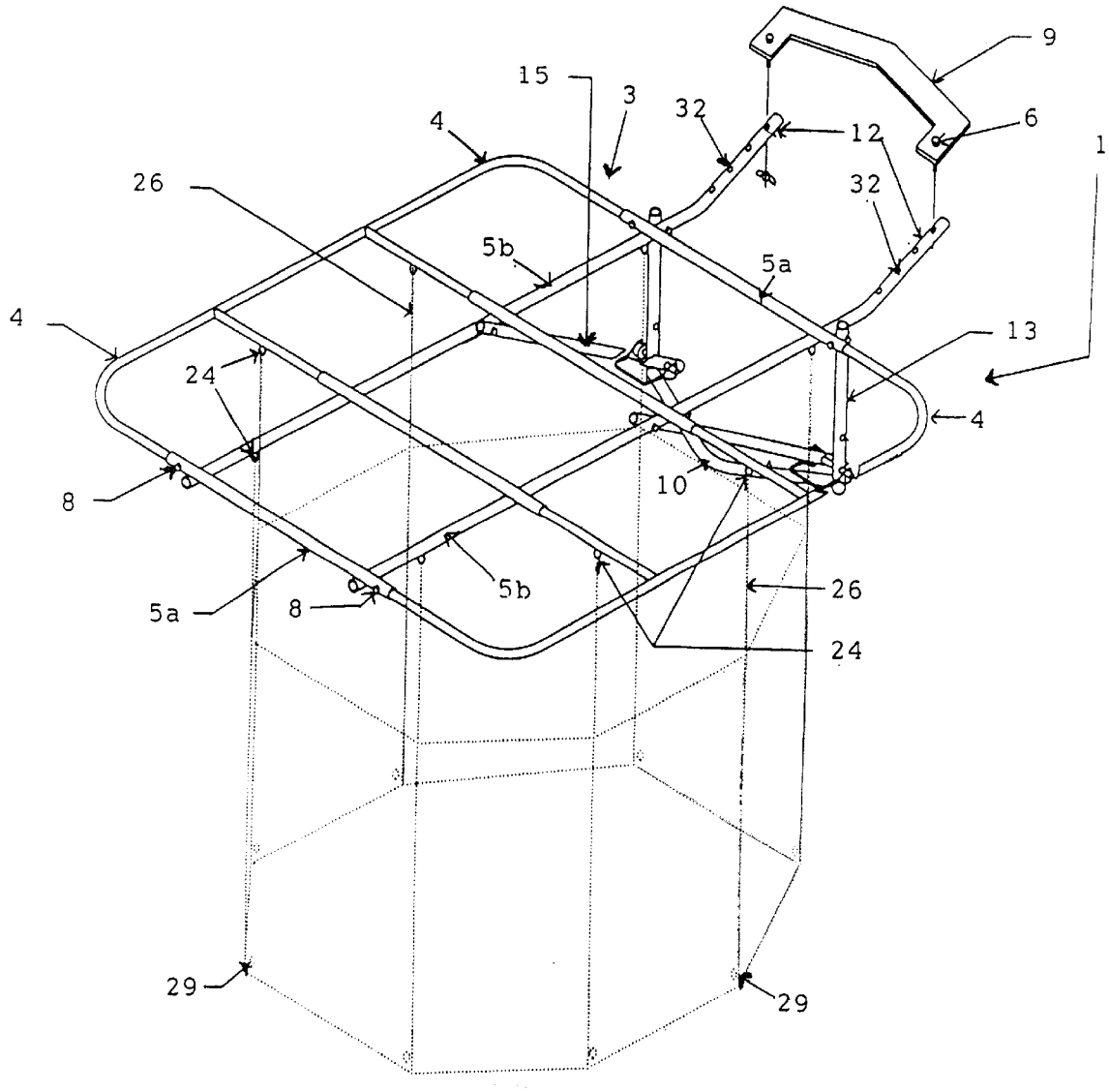
FIG. 1 is a perspective view of the frame of the present invention with the rain fly removed.

FIG. 1 illustrates the main components of the present invention, portable shelter 1. For clarity, FIG. 1 does not show rainfly 20 (seen in FIG. 2) and camouflage curtain 27 (seen in FIG. 3), both of which are discussed below. Portable shelter 1 will generally comprise a frame 3 which further includes side frame members 4 and mid frame members 5*a* and 5*b*. In the embodiment of FIG. 1, these frame members 4 and 5 are made of a metal tubing such as an aluminum alloy, but could be constructed of any material having any cross-sectional shape (e.g. such as angle iron) fulfilling the functions set forth herein. It can be seen how frame mid frame members 5 run in a lateral direction (members 5*a*) and a longitudinal direction (members 5*b*). The longitudinal and lateral frame members 5 may connected by welding, screws, bolts or any other conventional means. In the embodiment seen in the figures, side frame members 4 are of a smaller diameter than mid frame members 5 and will slide within mid frame members 5. Stop bolts 8 will be inserted through mid frame member 5 and side frame member 4 to maintain the position of side frame members 4 relative to mid frame members 5.

Attached to the rear of frame 3 are tension members 12 which will be placed in tension when frame 3 is attached to a tree by way of upper tree gripping bracket 9 engaging tension members 12. In the embodiment shown in the figures, tension members 12 are an extension of longitudinal mid frame members 5*b*. Tension members 12 include a plurality of apertures 32 which allows upper tree gripping bracket 9 to be positioned closer or further from frame 3 in order to accommodate different tree diameters. Tree gripping bracket 9 seen in the figures is a rigid metal member. However, bracket 9 could also be a flexible member such as a length of chain, a high strength plastic member or any other conventional means which encircles the tree and attaches to tension members 12. Other components of portable shelter 1 are better seen in FIG. 2, which shows certain parts of frame 3 cut away. Vertical spacing member 13 is attached to tension member 12 and extends downward therefrom. In the embodiment shown, vertical spacing member 13 is pinned in a manner that allows it to rotate with respect to tension member 12. Attached to the lower end of vertical spacing member 13 (by bolts or other conventional means) is lower tree gripping bracket 10. Lower bracket 10 may include spikes 11 to aid it in gripping a tree to which portable shelter 1 is attached. FIG. 2 also illustrates how two compression members 15 will be positioned between longitudinal mid frame members 5*b* and the lower end of vertical spacing member 13. Compression members 15 will be pivotally attached to mid frame members 5*b* with a bolt or other conventional means. Tension members 12, compression members 15, vertical spacing member 13 will be constructed of metal tubing such as an aluminum alloy, but could be constructed of any material having any cross-sectional shape (e.g. such as angle iron) fulfilling the functions set forth herein.

It can be seen in FIG. 2 how vertical spacing members 13 have a plurality of apertures 17 formed in their lower ends. These apertures 17 form adjustment sites 16 which may be used to pivotally pin compression member 15 a different levels on vertical spacing member 13. In the embodiment shown, a pin 7 engages an aperture in compression member 15 and then engages an aperture 17. Pin 7 will be a type which is easily removable from one aperture 17 when it is desired to re-position compression member 15 at a different height along vertical spacing member 13. While adjustment sites 16 in the embodiments shown are apertures 17, it will be understood that adjustment site 16 could encompass any manner of fixing the end of compression member 15 to a given height on vertical spacing member 13, regardless of whether apertures were formed in vertical spacing member 13.

Figures 3A, 3B, 3C:
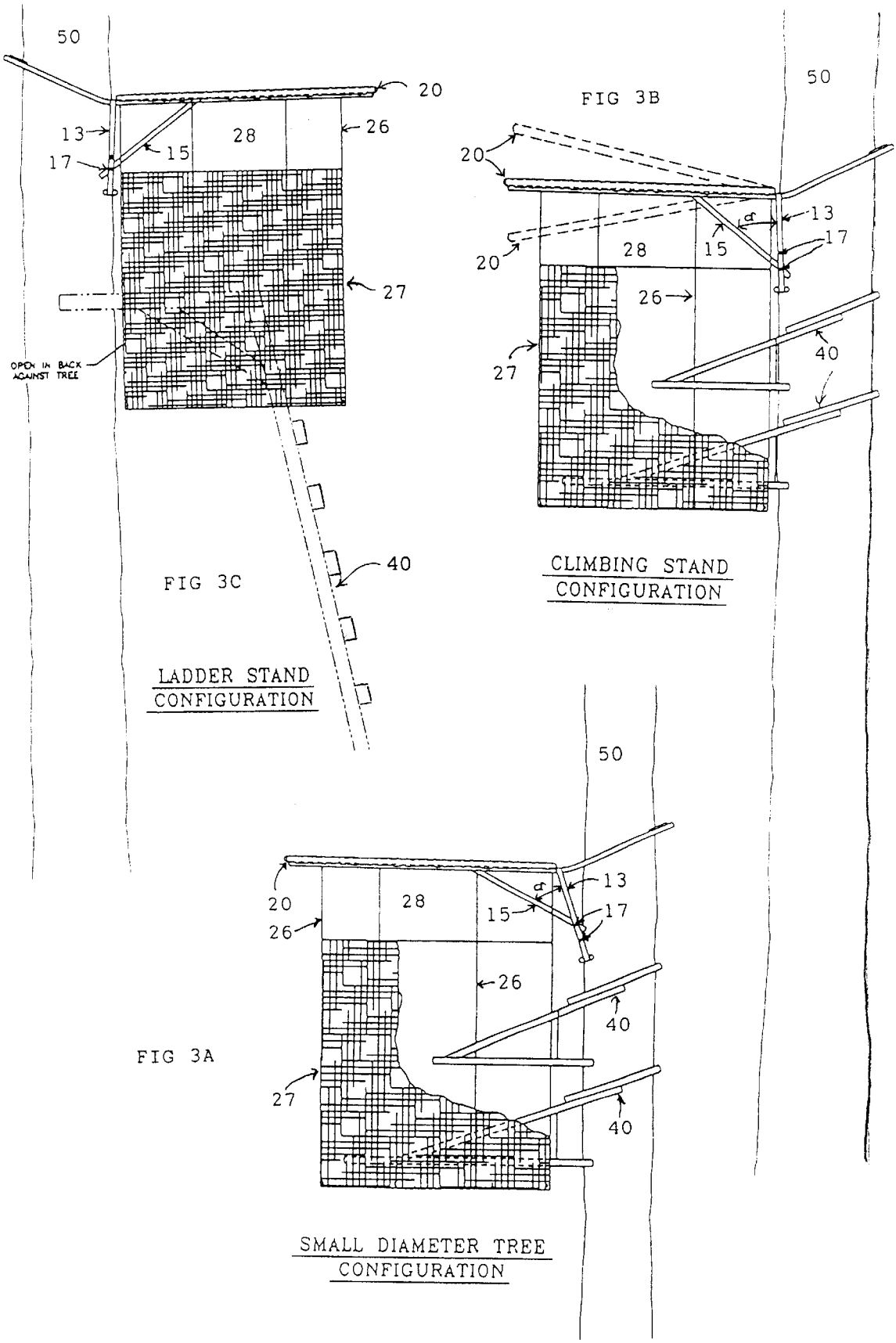
FIG. 3A is a side view of the present invention positioned within a tree and used in conjunction with a conventional "climbing stand" type tree stand.
FIG. 3B is similar to FIG. 3A but illustrates the frame attached to a larger diameter tree and adjusted accordingly.
FIG. 3C is a side view of the present invention positioned within a tree and used in conjunction with a conventional "ladder stand" type tree stand.

As best seen in FIG. 2, the primary function of frame 3 is to support rain fly 20. FIG. 2 illustrates how rain fly 20 will enclose frame 3 (shown in phantom) and underside edge 34 of rain fly 20 will wrap around side frame members 4. A retaining member such as elastic cord 21 or a similar retaining device will maintain rain fly 20 in position on frame 3. In the embodiment shown, elastic cord 21 is sown into the edge of rain fly 20 and in the relaxed position, the circumference of elastic cord 21 is less than that of frame 3. As seen in FIGS. 3A, 3B and 3C, a camouflage curtain 27 may also be positioned to hang from frame 3. FIG. 3A shows portable shelter 1 positioned on a tree and used in conjunction with a convention "climbing" tree stand 40. FIG. 3A illustrates how it is envisioned that portable shelter 1 will be commonly employed over tree stand 40. FIG. 2 illustrates how support eyes 24 will be positioned at various points on frame 3 and cords 26 will hang from support eyes 24. While camouflage curtain 27 is not shown in FIG. 1 for clarity's sake, it will be understood that hold down eyelets 29 may be installed into curtain 27 in order to secure the lower ends of curtain 27 to a tree or the like. It can be seen in FIGS. 3A, 3B and 3C that curtain 27 does not extend all the way up to rain fly 20. Rather, open areas or windows 28 are formed between the top of curtain 27 and rain fly 20. It will be apparent that windows 28 allow the hunter to have an unobstructed view out of his blind and to aim his firearm at game or other targets.

The effect of adjusting compression member 15 is best seen in FIGS. 3A and 3B. FIGS. 3A and 3B show portable shelter 1 connected to two different diameter trees 50. In FIG. 3A, the portable shelter 1 is positioned around a smaller diameter tree 50. It can be seen that compression member 15 is pinned to a higher aperture 17. This results in the angle alpha ($\alpha$) between compression member 15 and vertical spacing member 13. As can be seen in FIG. 3A, this results in frame 3 and rain fly 20 extending over tree stand 40 in an orientation substantially horizontal to the ground. This is a more desirable orientation than the rain fly 20 being cantered up or down as shown will broken lines in FIG. 3B. If rain fly 20 is cantered up, it is less effective in keeping the area underneath dry. If rain fly 20 is cantered downward, it will interfere with the hunter's line of sight and his ability to freely aim and traverse his firearm.

However, when portable shelter 1 is mounted on a tree with a larger diameter as seen in FIG. 3B, the relationship between compression member 15 and vertical spacing member 13 must be altered (and thus the angle $\alpha$ changed) in order to maintain rain fly 20 in a level orientation. This is accomplished by pinning compression member 15 to a lower aperture 17 as seen in FIG. 3B. In this manner, the angle a may be adjusted to maintain rain fly 20 in a level position even though the diameter of the tree to which portable shelter 1 is attached varies greatly.

Because portable shelter 1 will typically be carried by a hunter while he or she is climbing into a "ladder" type tree stand (such as seen in FIG. 3C), the portable shelter must be comparatively light. The metal tubing material disclosed above allows portable shelter to weigh less than 50 lbs. In a preferred embodiment, portable shelter 1 will weigh less than 25 lbs. and most preferably, less than 16 lbs. Regarding rain fly 20 and camouflage curtain 27, these materials are not necessarily any particular color or pattern. In the embodiments shown, rain fly 20 should be a water resistant material, such as conventional water proof nylon preferably having a camouflage pattern printed thereon. Similarly, curtain 27 is preferably form of conventional water proof nylon and preferably has a camouflage pattern printed thereon. Nevertheless, the material, color, and pattern of rain fly 20 and curtain 27 could vary greatly depending on the hunting environment in which portable shelter 1 is employed.

Although the preferred embodiment has been described, it will be appreciated by those skilled in the art to which the present invention pertains that modifications, changes, and improvements may be made without departing from the spirit of the invention defined by the claims.

I claim:

1. A portable shelter for a tree blind comprising:

a) an upper tree gripping bracket;

b) a tension member extending from said upper tree gripping bracket and operatively connecting to an overhead frame;

c) a vertical spacing member maintaining a vertical distance between said upper tree gripping bracket and a lower tree gripping bracket;

d) a compressive member extending between said vertical spacing member and said overhead frame;

e) wherein said compressive member is adjustable relative to said vertical member.

2. The portable shelter for a tree blind according to claim 1, wherein said vertical spacing member has a plurality of adjustment sites positioned thereon, said adjustment sites allowing the vertical orientation of said compressive member to be changed relative to said vertical spacing member.

3. The portable shelter for a tree blind according to claim 2, wherein said adjustment sites comprise a series of bolt apertures.

4. The portable shelter for a tree blind according to claim 1, wherein said portable shelter weighs less than fifty lbs.

5. The portable shelter for a tree blind according to claim 1, wherein said lower tree gripping bracket includes a spike for engaging a tree.

6. The portable shelter for a tree blind according to claim 1, wherein said shelter includes a rain fly positioned on said overhead frame.

7. The portable shelter for a tree blind according to claim 6, wherein said rain fly includes an elastic member fixed around said rain fly's perimeter.

8. The portable shelter for a tree blind according to claim 1, wherein said shelter includes a camouflage curtain.

9. The portable rain shelter for a tree blind according to claim 8, wherein said camouflage curtain includes a viewing window formed therein.

10. The portable shelter for a tree blind according to claim 3, wherein said shelter includes a rain fly positioned on said overhead frame.

11. The portable rain shelter for a tree blind according to claim 4, wherein said portable shelter weights less than twenty-five lbs.

12. A portable shelter for a tree blind comprising:

a) an upper tree gripping bracket;

b) a tension member extending from said upper tree gripping bracket and operatively connecting to an overhead frame;

c) a vertical spacing member maintaining a vertical distance between said upper tree gripping bracket and a lower tree gripping bracket;

d) a compressive member extending between said vertical spacing member and said overhead frame;

e) a means for adjusting said compressive member relative to said vertical member.

* * * * *